US006739769B2

(12) United States Patent
Nishikawa

(10) Patent No.: US 6,739,769 B2
(45) Date of Patent: May 25, 2004

(54) PHOTOGRAPHIC FILM DEVELOPING APPARATUS

(75) Inventor: Hidetoshi Nishikawa, Kishigawa-cho (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 10/316,846

(22) Filed: Dec. 12, 2002

(65) Prior Publication Data

US 2003/0113113 A1 Jun. 19, 2003

(30) Foreign Application Priority Data

Dec. 14, 2001 (JP) ..... 2001-382076

(51) Int. Cl.[7] ..... G03D 5/00

(52) U.S. Cl. ..... 396/604; 396/612; 396/618; 396/627; 396/27

(58) Field of Search ..... 396/604, 611, 396/612, 627; 355/27–29; 134/64 P, 64 R, 122 P, 122 R

(56) References Cited

U.S. PATENT DOCUMENTS 4,015,103 A * 3/1977 Cherian ..... 219/216
4,340,438 A * 7/1982 Davis ..... 101/25
5,027,146 A * 6/1991 Manico et al. ..... 396/575
5,081,526 A * 1/1992 Yoshikawa ..... 358/503
5,414,488 A * 5/1995 Fujita et al. ..... 355/30
6,126,339 A * 10/2000 Kobayashi ..... 396/626

FOREIGN PATENT DOCUMENTS

EP 0 984 324 A 3/2000

* cited by examiner

*Primary Examiner*—D. Rutledge
(74) *Attorney, Agent, or Firm*—Smith Patent Office

(57) ABSTRACT

A photographic film developing apparatus maintains a photographic film, a developer solution and a second processing solution at a specific temperature while performing film development operation by directly applying the individual solutions to an emulsion side of the photographic film. After the developer solution and the second processing solution have been applied from respective processing solution application heads to the emulsion side of the photographic film, the quantity of each solution on the emulsion side is adjusted to form a layer of a specified thickness. While transfer belts advance each successive portion of the photographic film up to a processing solution wipe-out device, heaters provided close to the transfer belts heat the individual solutions applied to the photographic film through the transfer belts to maintain the solutions at the specific temperature.

22 Claims, 2 Drawing Sheets

PHOTOGRAPHIC FILM DEVELOPING APPARATUS

BACKGROUND OF THE INVENTION AND RELATED ART STATEMENT

1. Field of the Invention

The present invention relates to a photographic film developing apparatus for developing a color photographic film.

2. Description of the Prior Art

Due to a reduction in the size of photographic film developing apparatus and photographic printing apparatus associated with their price reduction, the number of small-scale photographic processing shops (or so-called "minilabs") has rapidly increased in recent years. Having such apparatus at their shops, these minilabs develop films and produce photographic prints very quickly. Also becoming common today is the use of digital cameras, in place of conventional film cameras. As a result, the number of films developed at a single small-scale photographic processing shop is decreasing these days and this tendency is supposed to continue.

In a conventional photographic film developing apparatus, the film is developed as it is transferred through a series of tanks filled with a developer solution, a bleaching solution, a fixer solution and a stabilizer solution. As the number of films developed at a photographic processing shop is decreasing as stated above, these solutions are replaced less frequently. While the individual solutions deteriorate as the number of processed films increases, they also deteriorate with the lapse of time due to evaporation of water, for example. It is likely that the quality of images on negative films developed at a small-scale photographic processing shop which processes a small number of films varies over the course of time.

In addition, maintenance cost of a less frequently used photographic film developing apparatus and cost of a shop space occupied by the apparatus impose an economic burden on the small-scale photographic processing shop where the number of processed films is small. Such economic burden would eventually drive the shop into a difficult financial status.

One previous approach to the solution of this problem is a photographic film development method proposed in Japanese Unexamined Patent Publication No. S62-92957, for example, in which appropriate amounts of individual solutions are directly sprayed or applied to an emulsion side of a photographic film. Since this film development method (hereinafter referred to as the direct application development method) utilizes unused processing solutions each time the film is developed, it is possible to produce images of a stable quality on the developed negative film. Furthermore, the direct application development method facilitates maintenance of a photographic film developing apparatus and helps reduce its overall physical size, because there is no longer the need for solution tanks.

It is known that chemical reaction in each process of photographic film development is controlled by the temperature of a processing solution and reaction time in the processing solution. For this reason, each processing solution is controlled to a specific temperature (e.g., 38°) as it is applied to the emulsion side of the photographic film regardless of seasons. Since the photographic film is normally stored at room temperature just until it is developed, however, its temperature varies from season to season.

In the conventional photographic film developing apparatus in which a photographic film is passed through a series of tanks filled with the processing solutions, the individual processing solutions have large thermal capacities and the tanks are provided with heaters for regulating the temperature of the solutions. The conventional photographic film developing apparatus thus constructed can maintain a stable quality in performing film development operation regardless of the temperature of the photographic film.

The photographic film developing apparatus employing the aforementioned direct application development method applies as small amounts of processing solutions as possible to the emulsion side of the photographic film, because the individual solutions are disposed of after use. Thus, the solutions used in the direct application development method have small thermal capacities and this poses a problem that the quality of images developed on the film is susceptible to the influence of the film temperature, resulting in seasonal variations in overall quality of the film development operation. One approach to the solution of this problem would be to store the photographic film in an atmosphere of an intended processing temperature for a specific period of time so that the entire film reaches a specific temperature before it is subjected to the development operation. However, this film preheating process takes time and, for a small-scale photographic processing shop which trades on quickness, causes a loss of competitiveness against other shops of the same scale.

SUMMARY OF THE INVENTION

In light of the aforementioned problems of the prior art, it is an object of the invention to provide a photographic film developing apparatus which can maintain a photographic film and processing solutions at a specific temperature while performing film development operation by directly applying the processing solutions to an emulsion side of the photographic film.

According to the invention, a photographic film developing apparatus for developing a photographic film by directly spraying or applying a processing solution to an emulsion side of the photographic film while it is being transferred at a specific speed comprises a transfer belt which comes into contact with a non-emulsion side of the photographic film when transferring it in a particular direction, and a heater for heating a contact surface of the transfer belt which comes into contact with the non-emulsion side of the photographic film to a specific temperature.

In this construction, the photographic film is heated from its non-emulsion side by the heater through the transfer belt during development operation, so that it is possible to maintain the entire photographic film and the processing solution sprayed or applied to the emulsion side of the photographic film generally at a specified temperature.

These and other objects, features and advantages of the invention will become more apparent upon reading the following detailed description along with the accompanying drawings.

DETAILED DESCRIPTION OF THE PREFERRED EMBODIMENTS OF THE INVENTION

A preferred embodiment of the invention is now described with reference to the drawings, in which perforations in a photographic film are not illustrated for the sake of simplicity.

Figure 1:
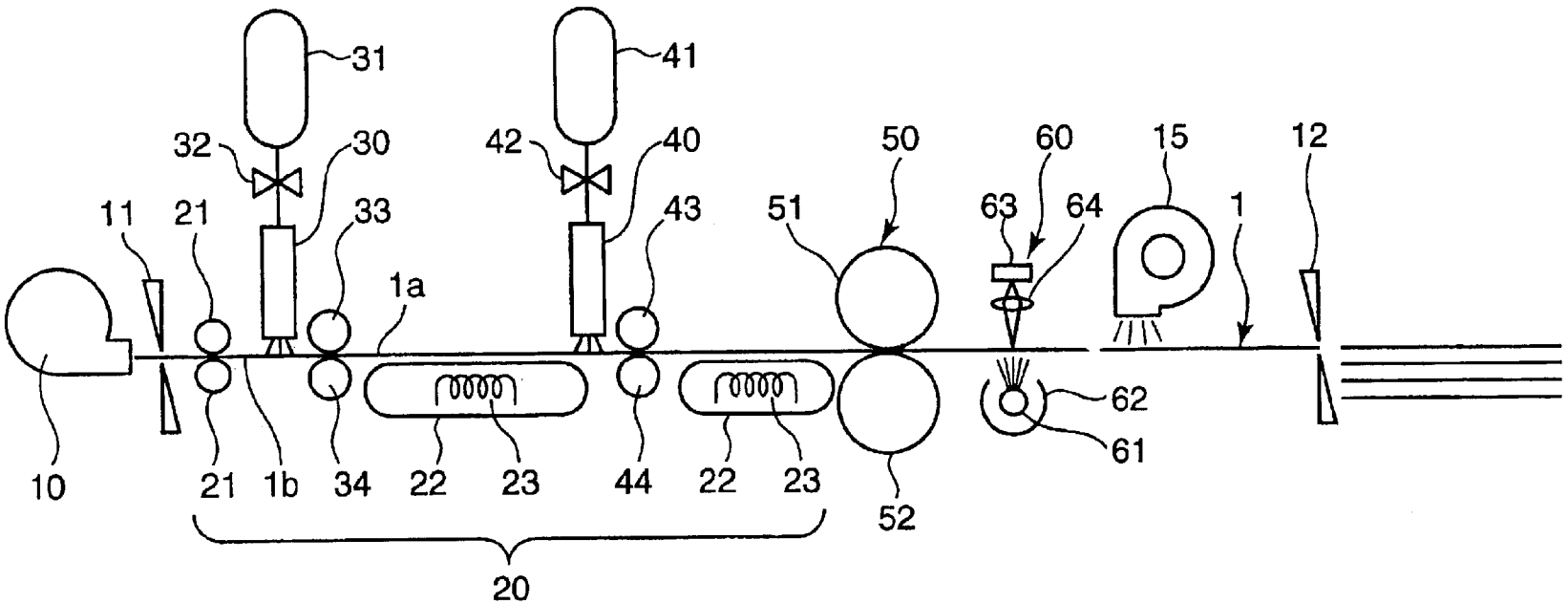
FIG. 1 is a diagram generally showing the construction of a photographic film developing apparatus according to a preferred embodiment of the invention.

FIG. 1 generally shows the construction of a photographic film developing apparatus according to the embodiment. In this photographic film developing apparatus, a photographic film 1 pulled out of a cartridge 10 is transferred at a constant speed in a specific direction (rightward as illustrated) by a film transfer mechanism 20 which includes transfer rollers 21 and transfer belts 22. The locations and the numbers of the transfer rollers 21 and the transfer belts 22 are not limited to the illustrated example but may be changed as necessary. Details of the transfer rollers 21 and the transfer belts 22 will be described later.

When the photographic film 1 is of the 135 type (i.e., 35 mm film), there is provided a first cutter 11 near the cartridge 10 for cutting a terminal portion of the photographic film 1. Also, a second cutter 12 for cutting the developed photographic film 1 to specific lengths is provided close to a terminal end of the film transfer mechanism 20. When the photographic film 1 is of the Advanced Photo System (APS) type, the photographic film 1 is stored again into its original cartridge without being cut, so that neither the first cutter 11 nor the second cutter 12 is necessary.

On a downstream side of the first cutter 11 in the film transfer direction, there are provided a first processing solution application head 30 for directly spraying or applying a developer solution to an emulsion side 1*a* of the photographic film 1, a first storage reservoir 31 for storing the developer solution, a first valve 32 for regulating the amount of the developer solution supplied to the first processing solution application head 30 and first application thickness regulating rollers 33 and 34 for adjusting the amount of the developer solution applied to the emulsion side 1*a* to form a layer of a specified thickness.

On a downstream side of the first application thickness regulating rollers 33 and 34, there are provided a second processing solution application head 40 for directly spraying or applying a processing solution other than the developer solution, such as a mixture of bleaching and fixer solutions, a second storage reservoir 41 for storing the processing solution, a second valve 42 for regulating the amount of the processing solution supplied to the second processing solution application head 40 and second application thickness regulating rollers 43 and 44 for regulating the amount of the processing solution applied to the emulsion side 1*a* to form a layer of a specified thickness.

On a downstream side of the second application thickness regulating rollers 43 and 44, there is provided a processing solution wipe-out device 50 including a pair of squeeze rollers 51, 52 for wiping the processing solutions off the emulsion side 1*a* of the photographic film 1. Further on a downstream side of the processing solution wipe-out device 50, there are accommodated individual constituent elements of an image reading device 60 for optically reading an image developed on the photographic film 1 and outputting image data obtained.

The distance between the first processing solution application head 30 and the second processing solution application head 40 is set such that each successive portion of the photographic film 1 takes a period of time that is necessary for development to advance from the first processing solution application head 30 to the second processing solution application head 40 when transferred at the aforementioned constant speed. Similarly, the distance between the second processing solution application head 40 and the processing solution wipe-out device 50 is set such that each successive portion of the photographic film 1 takes a period of time that is necessary for reaction with the processing solution to advance from the second processing solution application head 40 to the processing solution wipe-out device 50 when transferred at the aforementioned constant speed.

The image reading device 60 provided on the downstream side of the processing solution wipe-out device 50 includes a linear light source 61 for projecting light on a non-emulsion side 1*b* of the photographic film 1, a reflector 62 for reflecting the light, an image pickup device 63, such as a charge-coupled device (CCD), provided on the side of the emulsion side 1*a* of the photographic film 1 for capturing the image developed on the photographic film 1, and an imaging lens 64 for focusing the image on the photographic film 1 onto a light-sensitive surface of the developer solution 3.

There is provided a drier 15 for drying the photographic film 1 which has been wetted by the processing solutions on a downstream side of the image reading device 60, and the aforementioned second cutter 12 is provided further downstream of the drier 15.

One or more heaters 23 for maintaining the photographic film 1 (more strictly the developer solution or other processing solution which has been soaked by an emulsion layer of the photographic film 1) at a specific temperature are provided inside (or close to) each transfer belt 22 for transferring the photographic film 1. Needless to say, the film transfer speed is matched with image reading speed of the image reading device 60.

A method of developing the photographic film 1 according to the present embodiment is now described. This embodiment employs a direct application development method in which each processing solution is directly sprayed or applied to the emulsion side 1*a* of the photographic film 1. In particular, this embodiment employs a simplified quick development method in which, among development, bleaching, fixing and stabilization processes, the stabilization process and at least one process excluding the development process are omitted. This means that the simplified quick development method can take one of three forms, that is, the development process only, the development and bleaching processes, or the development and stabilization processes. When only the development process is performed, the second processing solution application head 40, the second storage reservoir 41, the second valve 42 and the second application thickness regulating rollers 43, 44 are not necessary. It should be pointed out that the invention is not limited to the present embodiment but may be reconfigured to perform the development, bleaching and fixing processes, or all of the development, bleaching, fixing and stabilization processes. In these alternative forms of the invention, appropriate processing solution application heads and associated elements should be additionally provided depending on the processes performed. It is to be noted that the processing solutions including the developer solution used in this invention are of high-viscosity type, such as gels, as compared to the processing solutions used in the conventional photographic film developing apparatus provided with solution tanks.

Here, development of a negative color photographic film is briefly explained. In the negative color photographic film, color dyes are produced to form a color image through a reaction using silver as a catalyst. An unexposed emulsion layer contains silver in the form of silver halides. When exposed, the silver halides are converted into metallic silver. As the exposed color photographic film is soaked in a developer solution, its exposed areas where the silver halides have been converted into metallic silver form a color image while unexposed areas containing original silver halide grains do not form any image. The developed color photographic film is then soaked into bleaching and fixer solutions in sequence to remove metallic silver and the remaining silver halides (desilverization) as well as color-forming agents which have not turned into color dyes. Commonly known development operation is completed by subsequently performing a stabilization process to produce an ordinary print-ready color negative film. A small portion of an antihalation backing (typically a brown layer) on the non-emulsion side of the photographic film is removed in the bleaching process and the remainder is completely removed in the fixing process.

When the simplified quick development method omitting the fixing process is used, on the other hand, the antihalation backing on the non-emulsion side of the photographic film 1 is not completely removed and some portion of the silver halides, metallic silver and color-forming agents which have not turned into color dyes in the emulsion layer remain unremoved. Consequently, the photographic film 1 processed by the simplified quick development method does not have the transparency-like appearance of the ordinary negative film. If the photographic film 1 which has not been subjected to the fixing process is exposed again, previously unexposed silver halides left in the emulsion layer are converted into metallic silver. Unless such metallic silver is reacted with the developer solution, however, the metallic silver does not turn the color-forming agents into color dyes. Therefore, it is possible to produce an ordinary print-ready color negative film by performing at a later time the fixing and stabilization processes on the photographic film 1 which has not been subjected to the fixing process. This means that no practical problem arises even if the photographic film 1 developed by the simplified quick development method omitting the fixing process is illuminated by the image reading device 60 as it reads images on the photographic film 1, dried and cut to the specific lengths for delivery to a customer.

Figure 2:
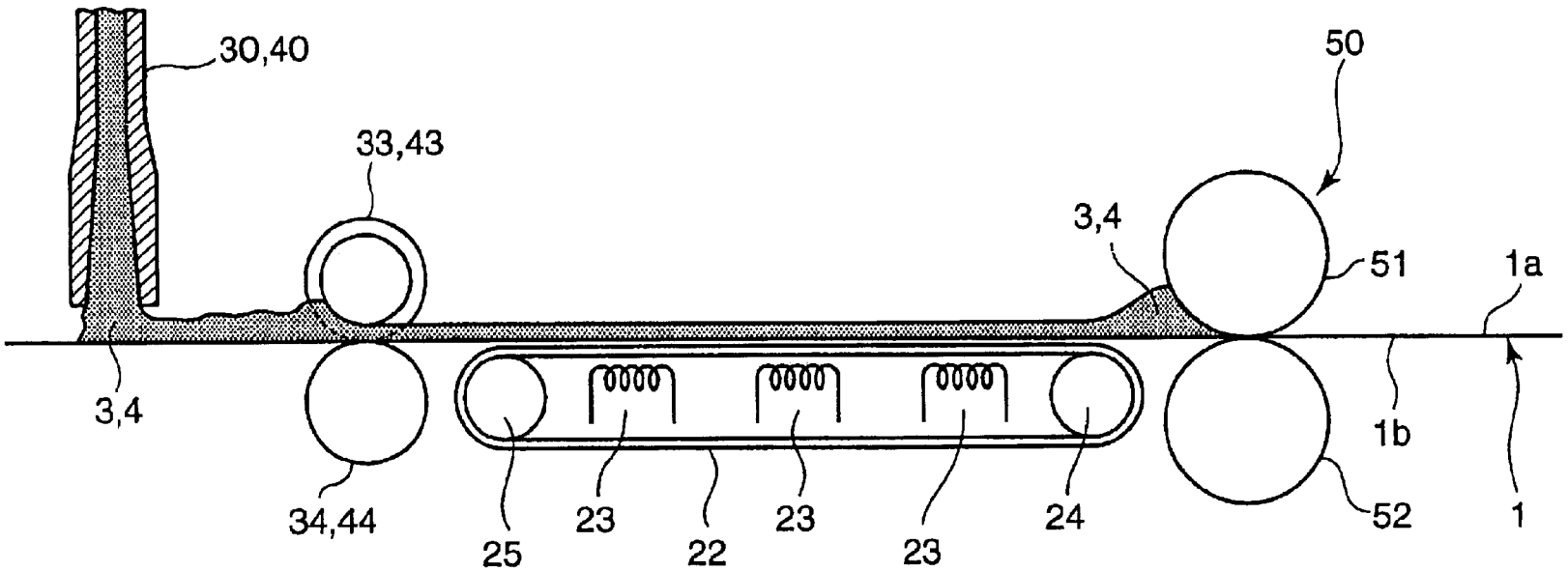
FIG. 2 is a sectional diagram particularly showing the construction of principal elements of the photographic film developing apparatus shown in FIG. 1.

FIG. 2 shows the detailed construction of principal elements of the photographic film developing apparatus according to the embodiment.

Among the first application thickness regulating rollers 33, 34 and the second application thickness regulating rollers 43, 44, the rollers 34 and 44 located on the side of the antihalation backing come into contact with the non-emulsion side 1*b* of the photographic film 1 all across the width of the photographic film 1 as shown in FIG. 2. On the other hand, the rollers 33 and 43 on the side of the emulsion side 1*a* of the photographic film 1 come into contact only with optically nonsensitive portions of the photographic film 1 along its side edges (e.g., both areas of perforations along the 135-type film) without going into direct contact with light-sensitive portions of the photographic film 1. This is because cylindrical outer surfaces of these rollers 33, 43 are raised by approximately 0.5 to 1.0 mm, for instance, at their end portions, leaving recessed portions at the middle of their length. With this structure, the side edge portions of the photographic film 1 are squeezed between the first application thickness regulating rollers 33 and 34, whereby slack or warpage of the photographic film 1 in the direction of its width is removed and the emulsion side la formed on the photographic film 1 is maintained generally flat.

The developer solution 3 and another processing solution 4 sprayed or applied to the emulsion side 1*a* of the photographic film 1 from the first processing solution application head 30 and the second processing solution application head 40 are once blocked by the rollers 33 and 43, respectively, and can pass through the recessed portions in the cylindrical outer surfaces of the rollers 33 and 43. This serves to regulate the layers of the developer solution 3 and the processing solution 4 formed on the emulsion side 1*a* of the photographic film 1 to generally constant thicknesses (quantities) downstream of the first application thickness regulating rollers 33, 34 and the second application thickness regulating rollers 43, 44, respectively.

One each transfer belt 22 which comes into contact with the non-emulsion side 1*b* of the photographic film 1 and transfers the photographic film 1 is provided between the first application thickness regulating rollers 33, 34 and the second application thickness regulating rollers 43, 44 and between the second application thickness regulating rollers 43, 44 and the squeeze rollers 51, 52 constituting the processing solution wipe-out device 50. Each transfer belt 22 is stretched between a drive pulley 24 and an idle pulley 25 with the heaters 23 provided inside loops formed by the transfer belts 22. Each heater 23 may be a heat-generating electric conductor, such as a nickel-chromium alloy wire, or a heat-generating light-emitting device, such as a halogen lamp. Formed of thermosetting resin like polyimide, the transfer belts 22 are heated by the respective heaters 23 to a specified temperature (e.g., 38°). As the heated transfer belts 22 come in direct contact with the non-emulsion side 1*b* of the photographic film 1, they heat and maintain the photographic film 1 at a specific temperature. By increasing the thermal capacities of the transfer belts 22, it is possible to prevent temperature decrease of the developer solution 3 and the processing solution 4 applied to the emulsion side 1*a* of the photographic film 1, regardless of temperature differences between the transfer belts 22 and the photographic film 1, if any, In one varied form of the embodiment, a plurality of transfer rollers may be used as a substitute for the transfer belts 22, with heaters provided inside the individual transfer rollers. In this variation, however, individual areas of the emulsion side 1*a* of the photographic film 1 come in contact and go out of contact with the successive transfer rollers, alternately going through momentary contact states and prolonged noncontact states. Accordingly, this variation of the embodiment is likely to create an unevenly developed surface on the photographic film 1 due to temperature differences produced in the emulsion side 1*a* of the photographic film 1 during the development operation. It is therefore preferable to use the transfer belts 22 such that the emulsion side 1*a* of the photographic film 1 is kept in continuous contact with the transfer belts 22 during the development operation in order to prevent uneven film development.

As the photographic film 1 is subsequently squeezed between the squeeze rollers 51 and 52 constituting the processing solution wipe-out device 50, the developer solution 3 and the processing solution 4 applied to the emulsion side 1*a* of the photographic film 1 are wiped off the emulsion side 1*a* almost completely.

After the developer solution 3 and the processing solution 4 have been wiped off the emulsion side 1*a* almost completely by the squeeze rollers 51, 52, the image reading device 60 scans the image developed on the photographic film 1 to produce a least distorted high-quality picture. The image data picked up by the image pickup device 63 of the image reading device 60 is subjected to specific image processing operation, output to a digital photographic printing system (not shown) of the prior art, and stored on a storage medium, such as a Compact Disc-Recordable (CD-R). The digital photographic printing system prints the image on photographic printing paper using the input image data. The photographic film 1 cut to the specific lengths by the second cutter 12 is delivered to the customer together with the CD-R and finished prints. At the request of the customer, any process omitted in the above-described simplified quick development method may be performed later to complete the ordinary (conventional) development operation.

While the invention has been described with reference to its preferred embodiment employing the transfer belts 22 provided with the heaters 23 inside the loops formed by the transfer belts 22, the invention is not limited to this arrangement but may be varied in such a manner that the transfer belts 22 are made of "rubber heaters" (manufactured by Nippon Heater Co., Ltd.), each formed of an endless belt of glass-fiber-reinforced silicone rubber incorporating a heat-generating element. This variation of the embodiment makes it possible to directly heat the transfer belts 22 without heating their surfaces through a layer of air of which thermal conductivity is small. This results in an increase in thermal efficiency because the transfer belts 22 themselves serve as heaters.

In addition, although the foregoing embodiment employs the direct application development method in which each processing solution is directly sprayed or applied to the emulsion side 1*a* of the photographic film 1 combined, in particular, with the simplified quick development method in which, among the development, bleaching, fixing and stabilization processes, the stabilization process and at least one process excluding the development process are omitted, the invention is not limited to this embodiment but is also applicable to the conventional photographic film developing apparatus which passes a photographic film through a series of tanks filled with the individual processing solutions. When applied to the conventional photographic film developing apparatus, the invention makes it possible to print images on photographic printing paper using image data picked up from the photographic film during the development operation while the already developed negative film is being dried.

In summary, according to the invention described in the above passages, a photographic film developing apparatus for developing a photographic film by directly spraying or applying a processing solution to an emulsion side of the photographic film while it is being transferred at a specific speed comprises a transfer belt which comes into contact with a non-emulsion side of the photographic film when transferring it in a particular direction, and a heater for heating a contact surface of the transfer belt which comes into contact with the non-emulsion side of the photographic film to a specific temperature.

In this construction, the photographic film is heated from its non-emulsion side by the heater through the transfer belt during development operation, so that it is possible to maintain the entire photographic film and the processing solution sprayed or applied to the emulsion side of the photographic film generally at a specified temperature.

In particular, as the thermal capacity of the transfer belt can be made larger than that of the photographic film by choosing a transfer belt of an appropriate material, it is possible to reduce temperature variations of the photographic film and the processing solution during the development operation even if there are seasonal variations in the initial temperature of the photographic film. This makes it possible to maintain a stable quality in performing the film development operation regardless of the seasonal temperature variations.

In one aspect of the invention, the heater may be provided inside a loop formed by the transfer belt. This makes it possible to reduce space required for installing the heater, resulting in an overall size reduction of the photographic film developing apparatus.

In another aspect of the invention, the transfer belt may be made of a rubber heater which is formed of an endless belt of flexible resin material incorporating a heat-generating element. This makes it possible to directly heat the transfer belt without heating it through a layer of air of which thermal conductivity is small, resulting in an increase in thermal efficiency.

This application is based on Japanese Patent Application serial No. 2001-382076 filed with Japan Patent Office on Dec. 14, 2001, the contents of which are hereby incorporated by reference.

Although the invention has been described by way of example with reference to the accompanying drawings, it is to be understood that various changes and modifications will be apparent to those skilled in the art. Therefore, unless such changes and modifications depart from the scope of the invention hereinafter defined, they should be construed as being included therein.

What is claimed is:

1. A photographic film developing apparatus for developing a photographic film by directly spraying or applying a processing solution to an emulsion side of the photographic film while it is being transferred at a specific speed, said photographic film developing apparatus comprising:

a first storage reservoir for storing a developer solution;

a first solution application head for applying the developer solution onto an emulsion side of the photographic film;

a first application thickness regulating means provided on a downstream side of the first solution application head for regulating a thickness of the developer solution on the emulsion side of the photographic film;

a first transfer belt, provided on a downstream side of the first application thickness regulating means, which comes into contact with a non-emulsion side of the photographic film when transferring it in a particular direction; and a first heater for heating a contact surface of the first transfer belt which comes into contact with the non-emulsion side of the photographic film to a specific temperature.

2. The photographic film developing apparatus according to claim 1, wherein the heater is provided inside a loop formed by the transfer belt.

3. The photographic film developing apparatus according to claim 1, wherein the transfer belt is made of a rubber heater which is formed of an endless belt of flexible resin incorporating a heat-generating element.

4. The photographic film developing apparatus according to claim 2, wherein the heater includes a halogen lamp.

5. The photographic film developing apparatus according to claim 2, wherein the heater includes a nickel-chromium alloy wire.

6. The photographic film developing apparatus according to claim 3, wherein the transfer belt is made of a glass-fiber-reinforced silicone rubber.

7. The photographic film developing apparatus according to claim 1, wherein the specific temperature is approximately 38 degrees Celsius.

8. The photographic film developing apparatus according to claim 1, further comprising:

a second storage reservoir for storing a processing solution;

a second solution application head for applying the processing solution onto the emulsion side of the photographic film; and a second application thickness regulating means, provided on a downstream side of the second solution application head, for regulating the thickness of the applied processing solution on the emulsion side of the photographic film.

9. The photographic developing apparatus according to claim 8, further comprising:

a second transfer belt provided on a downstream side of the second application thickness regulating means, which comes into contact with a non-emulsion side of the photographic film when transferring the photographic film in the particular direction;

a second heater for heating a contact surface of the second transfer belt which comes into contact with the non-emulsion side of the photographic film to a specific temperature.

10. The photographic developing apparatus according to claim 9 further comprising:

a processing solution wipe-out unit provided on a downstream side of the second transfer belt for wiping out solutions applied to the photographic film.

11. The photographic developing apparatus according to claim 10, wherein the processing solution wipe-out unit includes a pair of squeeze rollers through which the photographic film bearing the developer solution and the process solution on the emulsion side thereof passes.

12. The photographic developing apparatus according claim 1, wherein the first application thickness regulating means includes a top roller and a bottom roller and the top roller has a portion of an outer cylindrical surface recessed by a certain amount such that opposite ends of the top roller and the bottom roller nip the photographic film from top and bottom and the first application thickness regulating means further includes a clearance with a certain dimension corresponding to the recessed portion of the top roller is formed so that the developer with the regulated thickness remains on the emulsion side of the photographic film after the film has passed through the first application thickness regulating means.

13. The photographic developing apparatus according to claim 8, wherein the second application thickness regulating means includes a top roller and a bottom roller and the top roller has a portion of an outer cylindrical surface recessed by a certain amount such that opposite ends of the top roller and the bottom roller nip the photographic film from top and bottom and the first application thickness regulating means further includes a clearance with a certain dimension corresponding to the recessed portion of the top roller is formed so that the process solution with the regulated thickness remains on the emulsion side of the photographic film after the film has passed through the second application thickness regulating means.

14. The photographic film developing apparatus according to claim 11, wherein the first heater is provided inside a loop formed by the first transfer belt.

15. The photographic film developing apparatus according to claim 14, wherein the second heater is provided inside a loop formed by the second transfer belt.

16. The photographic film developing apparatus according to claim 11, wherein the first transfer belt is made of a rubber heater which is formed of an endless belt of flexible resin incorporating a heat-generating element.

17. The photographic film developing apparatus according to claim 16, wherein the second transfer belt is made of a rubber heater which is formed of an endless belt of flexible resin incorporating a heat-generating element.

18. The photographic film developing apparatus according to claim 17, wherein the first heater includes a halogen lamp.

19. The photographic film developing apparatus according to claim 17, wherein the first heater includes a nickel-chromium alloy wire.

20. The photographic film developing apparatus according to claim 11, wherein the first transfer belt is made of a glass-fiber-reinforced silicone rubber.

21. The photographic film developing apparatus according to claim 20, wherein the second transfer belt is made of a glass-fiber-reinforced silicone rubber.

22. The photographic film developing apparatus according to claim 21, wherein the specific temperature is approximately 38 degrees Celsius.

* * * * *